US006113267A

United States Patent [19]

Roy

[11] Patent Number: 6,113,267

[45] Date of Patent: Sep. 5, 2000

[54] MEANS FOR ATTACHING HANDLES USEFUL ON PACKAGES

[76] Inventor: Ron Roy, 2219 W. Olive Ave., Suite 312, Burbank, Calif. 91506

[21] Appl. No.: 09/372,188

[22] Filed: Aug. 11, 1999

[51] Int. Cl.[7] ..... B65D 33/12

[52] U.S. Cl. ..... 383/13; 383/6; 383/14; 206/223

[58] Field of Search ..... 383/6, 13, 14, 383/18, 20; 206/223

[56] References Cited

U.S. PATENT DOCUMENTS

| | | | |
|---|---|---|---|
| D. 135,816 | 4/1943 | Appel . | |
| D. 148,321 | 1/1948 | Pichel . | |
| D. 305,728 | 1/1990 | Tufariello . | |
| D. 349,725 | 8/1994 | Roy . | |
| D. 354,912 | 1/1995 | Roy . | |
| 1,418,705 | 6/1922 | Groh | 383/20 |
| 2,006,786 | 7/1935 | Beauvisage . | |
| 2,021,787 | 11/1935 | Janowitz . | |
| 2,146,243 | 2/1939 | Aug | 383/4 X |
| 3,033,438 | 5/1962 | Glass . | |
| 3,105,628 | 10/1963 | Mack . | |
| 3,201,028 | 8/1965 | Fossler et al. | 383/13 X |
| 3,207,418 | 9/1965 | Kramming . | |
| 3,301,452 | 1/1967 | Jester . | |
| 3,409,209 | 11/1968 | Finke . | |
| 3,414,033 | 12/1968 | Tucker . | |
| 3,452,405 | 7/1969 | Paynor . | |
| 5,232,287 | 8/1993 | Roy . | |
| 5,352,042 | 10/1994 | Roy . | |

FOREIGN PATENT DOCUMENTS

| | | | |
|---|---|---|---|
| 2481090 | 10/1981 | France . | |
| 2633253 | 12/1989 | France . | |
| 86013 | 4/1936 | Sweden . | |
| 91586 | 2/1938 | Sweden . | |
| 483226 | 7/1959 | Switzerland . | |
| 483226 | of 0000 | United Kingdom . | |
| 1079683 | 8/1967 | United Kingdom | 383/13 |
| 1124724 | 8/1968 | United Kingdom | 383/13 |
| 2158347 | 11/1985 | United Kingdom | 383/6 |

*Primary Examiner*—Jes F. Pascua
*Attorney, Agent, or Firm*—Joseph E. Mueth

[57] ABSTRACT

A packet which enables the user to attach a pair of carrying handles to a package and containing a pair of flexible cords and four plastic members each having a flat surface coated with an adhesive and provided with an adherent protective strippable plastic film there over covering the flat surface, and an opposed surface. The opposed surface of each of the plastic members is provided with a normally integral raised portion, the improvement wherein the raised portion has a slot therein for receiving one end of said flexible cords with a snap fit to provide for ready attachment and detachment of the flexible cords. The flexible cords are adapted to be hand gripped together to provide a carrying handle for a package.

6 Claims, 2 Drawing Sheets

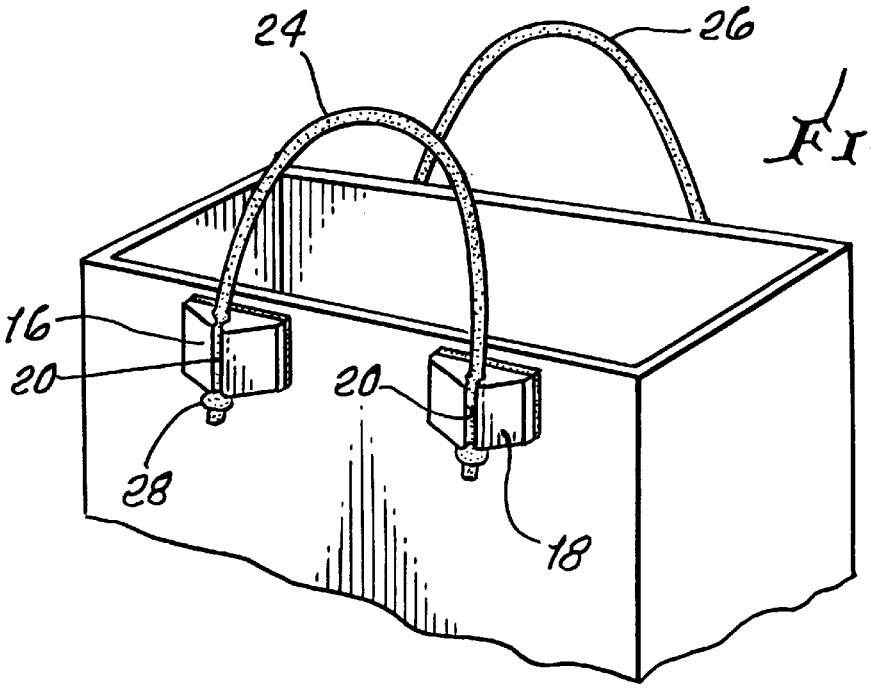
FIG. 1.
FIG. 2.
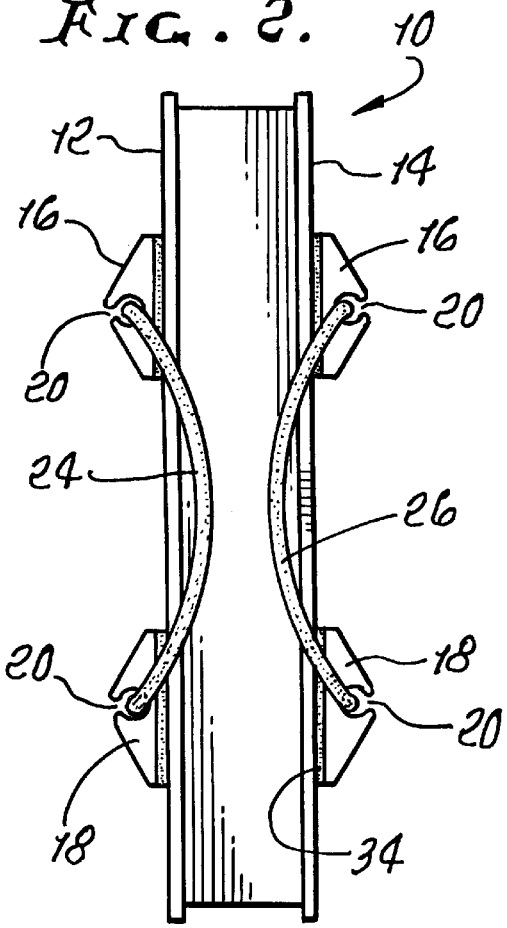
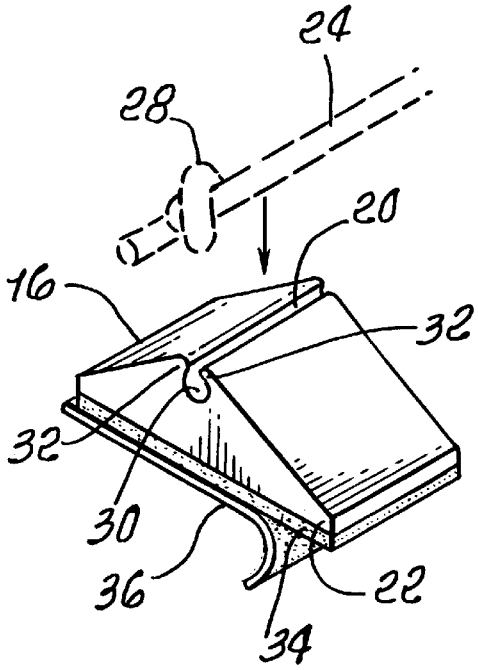
FIG. 3.

MEANS FOR ATTACHING HANDLES USEFUL ON PACKAGES

FIELD OF INVENTION

This invention relates to novel packages with handles and the means to apply such handles to packages.

BACKGROUND OF THE INVENTION

Various devices for carrying packages and providing packages with handles are known. U.S. Pat. No. 5,232,287 discloses a novel package having adhered thereto four pairs of spaced apart adhesive tabs, each tab having opposed adhesive surfaces, two of the pairs of tabs being at one side of the package and the other two at the opposite side of the package, slidably received in the space between each pair of tabs and extending between said two pairs of tabs at each side of the package, a flexible cord, one of said opposed surfaces being adhered to the package and the other opposed surface being adhered to a rigid plastic sheet which bridges the two of the pairs of spaced apart adhesive tabs, the tabs being about the same or slightly thicker than the diameter of said cords, and the flexible cords being adapted to be hand gripped together to provide a carrying handle for said package.

U.S. Pat. No. 5,352,042 describes a novel package having adhered thereto four spaced apart substantially rigid plastic members, each plastic member having an adhesive surface and an opposed surface, two of the plastic members being adhered to one side of the package with a flexible cord running there between, and the other two plastic members adhered to the opposite side of the package with a second separate flexible cord running there between, the opposed surfaces of each of the plastic members being provided with a raised portion having an opening there through in which is received an end of one of said flexible cords, wherein said flexible cords do not pass through the sides of the package, said flexible cords being adapted to be hand gripped together to provide a carrying handle for said package.

The present invention provides an improved and even more convenient way of providing carrying handles on packages.

It is sincerely believed that this invention is also entitled to a patent.

SUMMARY OF THE INVENTION

Briefly, the present invention comprises a packet which enables the user to attach and detach a pair of carrying handles to a package and containing a pair of flexible cords and four plastic members each having a flat surface coated with an adhesive and provided with an adherent protective strippable plastic film there over covering said surface, and an opposed surface, the opposed surface of each of said plastic members being provided with a normally integral raised portion, the improvement wherein the said raised portion has a slot therein for receiving one end of said flexible cords with a snap fit to provide for ready attachment and detachment of the flexible cords.

This invention further comprises a package having adhered thereto four spaced apart plastic members, each plastic member having an adhesive surface and an opposed surface, two of the plastic members being adhered to one side of the package with a flexible cord running there between, and the other two plastic members adhered to the opposite side of the package with a second separate flexible cord running there between, the opposed surfaces of each of the plastic members being provided with a raised portion, the improvement wherein the said raised portion has a slot therein for receiving one end of said flexible cord with a snap fit to provide for ready attachment and detachment of the flexible cords, said flexible cords being adapted to be hand gripped together to provide a carrying handle for said package.

It is an object of this invention to provide a novel packet which contains the elements necessary to provide a pair of attachable and detachable handles on any package.

It is also an object of this invention to provide a bag or book or the like with a pair of opposed handles by novel means.

It is an important object of this invention to provide means for attaching and detaching handles to a package in a simple and convenient manner.

These and other objects and advantages of this invention will be apparent from the detailed description which follows.

DESCRIPTION OF PREFERRED EMBODIMENTS

The accompanying drawings are for purposes of illustration and depict the presently known preferred mode for practicing this invention. No doubt, many variations on this invention will be evident to those skilled in the art.

FIG. 1 is a perspective view of the novel package of this invention.

FIG. 2 is a top view of the package of FIG. 1.

FIG. 3 is a perspective view of the plastic member which is used in the overall packages shown in FIGS. 1 and 2;

Figure 4:
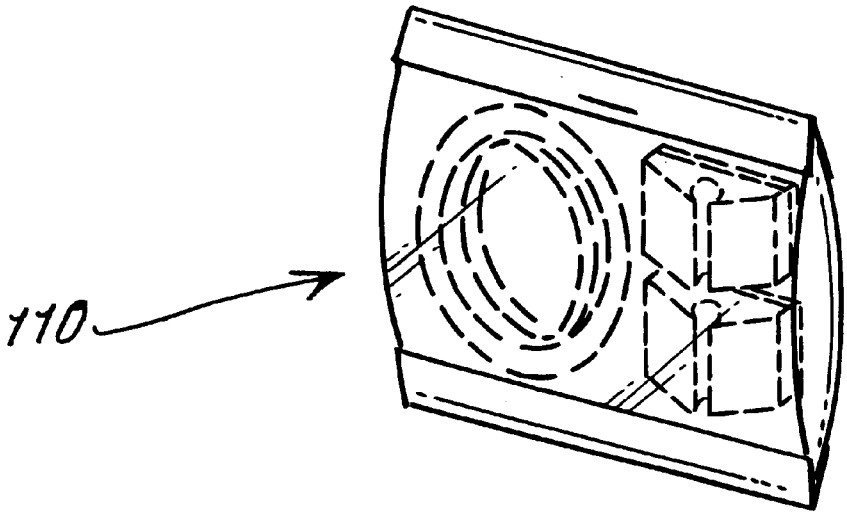
FIG. 4 is a packet containing elements of this invention.

Considering the drawings in greater detail.

In the drawings, the package 10, has adhere to each of its sides 12 and 14 two injection molded spaced apart plastic pieces 16 and 18. Each of these plastic pieces has a raised side provided with slot 20. The opposed side 22 is planar or flat. The cords 24 and 26 are either slidably or fixedly received in pass through 20. The extremities or ends of both cords 24 and 26 are knotted 28 or otherwise enlarged to limit travel of the cords within slot 20 and, hence, to be secured to the package.

The package 10 as shown is a box. The package can also be a bag, carton or the like.

The flat, planar surface 22 of each of the plastic pieces 16 and 18 are adhesive coated 34 so that side 22 is adherent to the surface of package 10. In FIG. 2, the adhesive coating is somewhat exaggerated in thickness for purpose of illustration.

The slot 20 is preferably key-hole shaped such that the closed end 30 of the slot 20 is enlarged to allow the cords 24 and 26 freely to slide therethrough, while at the same time the closed end 30 is smaller than knots 28 so that the knots cannot slide therethrough. The entry way 32 of slot 20 is slightly narrower than the diameter of the cords 24 and 26 and the plastic pieces 16 and 18 are made of a resilient, flexible plastic so that the cords 24 and 26 can be manually pressed through the entry way with a force or interference snap fit for attachment and detachment.

The cords 24 and 26 can be woven or twine, plastic, cotton, etc. As noted above, the knot 28 is larger than said closed end 30 to prevent the cord from being pulled out of the plastic pieces 16 and 18.

Considering FIG. 3, FIG. 3 shows one of the plastic pieces prior to application to a package 10. The adhesive coating 34 is present on surface or side 22. The protective strippable flexible plastic sheet 36 cover the adhesive surface and extend slightly beyond the edge of the surface to provide a finger grip for grasping and easy removal when applying the plastic pieces to a package.

The plastic pieces are typically injection molded from a resilient, flexible plastic and are about 1 inch by 2 inches in size (or larger for heavier loads).

The present invention provides a much easier way of attaching and detaching the cords 26 and 28. When a package is provided with cord handles, and the handles are not readily detachable, the package when checked through normal baggage handling equipment, such as at an airport, is subject to being damaged when the cords become caught in the baggage handling equipment. The present invention overcomes that problem by providing detachable handles which can be removed at check-in and hand carried in the pocket of the passenger for subsequent easy re-attachment at the point of baggage retrieval at the destination. The present invention enables multiple and repeated use of the same pair of handles on any number of different packages.

FIG. 4 shows a pair of plastic members with cord. As packaged for sale in packet 110, normally two pairs of plastic members and two cords are provided.

Having fully described the invention, it is intended that it be limited solely by the lawful scope of the appended claims.

I claim:

1. A packet which enables the user to attach and detach a pair of carrying handles to a package and containing a pair of flexible cords and four plastic members each having a flat surface coated with an adhesive and provided with an adherent protective strippable plastic film there over covering said surface, and an opposed surface, the opposed surface of each of said plastic members being provided with a raised portion, the improvement wherein the said raised portion has a slot therein for receiving one end of said flexible cords with a snap fit to provide for ready attachment and detachment of the flexible cords.

2. The packet of claim 1 wherein the slot has an open end for forcibly passing the flexible cords there through and a closed end in which the flexible cords are slidably received.

3. The packet of claim 2 wherein the ends of each of said flexible cords are adapted to be knotted to a thickness greater than the size of the said closed end.

4. A package having adhered thereto four spaced apart plastic members, each plastic member having an adhesive surface and an opposed surface, two of the plastic members being adhered to one side of the package with a flexible cord running there between, and the other two plastic members adhered to the opposite side of the package with a second separate flexible cord running there between, the opposed surfaces of each of the plastic members being provided with a raised portion, the improvement wherein the said raised portion has a slot therein for receiving one end of said flexible cords with a snap fit to provide for ready attachment and detachment of the flexible cords, said flexible cords being adapted to be hand gripped together to provide a carrying handle for said package.

5. The package of claim 4 wherein the slot as an open end for forcibly passing the flexible cords there through and a closed end in which the flexible cords are slidably received.

6. The package of claim 5 wherein the ends of each of said flexible cords are knotted to a thickness greater than the size of the said closed end.

* * * * *